US005497935A

United States Patent [19]

Gravier

[11] Patent Number: 5,497,935

[45] Date of Patent: Mar. 12, 1996

[54] AUTOMATED PRODUCTION LINES FOR ROLLED AND WELDED FERRULES

[75] Inventor: Michel Gravier, Aubergenville, France

[73] Assignee: Jammes Industrie S.A., Cebazat, France

[21] Appl. No.: 256,880

[22] PCT Filed: Feb. 15, 1993

[86] PCT No.: PCT/FR93/00152

§ 371 Date: Jul. 28, 1994

§ 102(e) Date: Jul. 28, 1994

[87] PCT Pub. No.: WO93/15856

PCT Pub. Date: Aug. 19, 1993

[30] Foreign Application Priority Data

Feb. 14, 1992 [FR] France ..... 92 02060

[51] Int. Cl.[6] ..... B21D 51/26; B23K 37/04

[52] U.S. Cl. ..... 228/17.5; 228/151

[58] Field of Search ..... 228/5.7, 17.5, 228/144, 149–151; 219/59.1

[56] References Cited

U.S. PATENT DOCUMENTS 4,824,007 4/1989 Depaoli et al. ..... 228/17.5

FOREIGN PATENT DOCUMENTS 0426258 5/1991 European Pat. Off. ..... 228/17.5

*Primary Examiner*—Samuel M. Heinrich

*Attorney, Agent, or Firm*—Curtis, Morris & Safford

[57] ABSTRACT

The invention is in the field of metallurgy and relates to an automatic machine for the continuous production of cylindrical shells from a pile of flat metal sheets. Said machine is characterized in that it is comprised of, from the output of the shell to the input of the metal sheet, a welding station provided with means for transferring and holding a rolled blank with jointed edges and means for the continuous formation of a welding bead along said edges, a station for the continuous transfer of the rolled blanks and for progressively tightening them, a station for the discontinuous transfer of the blanks to deliver them axially against each other, a rolling station consisting of a rolling machine, and a supply station comprising means for unpiling and transferring the metal sheets, and a servomechanism for adjusting the bending means as a function of the thickness of each sheet.

10 Claims, 4 Drawing Sheets

AUTOMATED PRODUCTION LINES FOR ROLLED AND WELDED FERRULES

Figure 1:
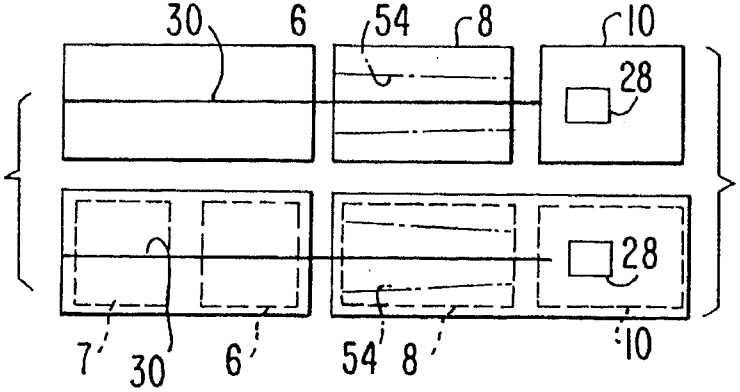
Figure 1:
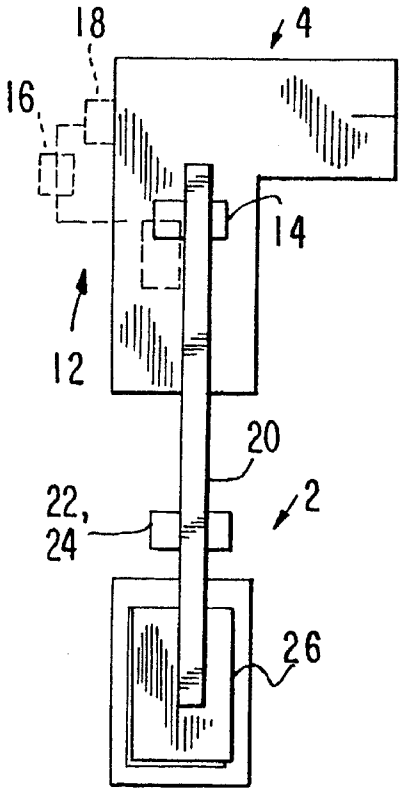

The present invention is in the metalworking field and has as its subject matter an automatic machine for the continuous production of ferrules from a stack of flat metal blanks.

A publication, FR2637206, by the applicant, has disclosed a machine, called a "rolling machine," having centering wheels enabling it to adjust in a precise manner to the rolling diameters; the description of this machine mentions that it is adapted to be associated with welding means.

Also known from the applicant's older publication, viz., FR2528335, is the association of a sensor with a machine for the purpose of measuring the thickness of the metal blanks before they enter the machine, this sensor having a direct mechanical action on the bending wheels so as to adjust them to the required rolling diameter.

The latter machine, however, was not designed to be associated with an automatic welding machine, and so the relatively imprecise action of the thickness sensor was satisfactory.

A first purpose of the invention is to propose an assemblage, called a "line," of means permitting metal blanks within thickness tolerances and of identical dimensions to be held, rolled and welded automatically (i.e., normally without human intervention).

To understand the technological background of the invention, publication EP 0426258 (THOMASSEN) may be consulted, which describes a machine of this kind, comprising mainly means for bending the blanks, means for the discontinuous transfer of the bent blanks, and welding means.

A problem of this machine is that the edges of the blanks are resistance welded overlapping one another; the applications of the ferrules obtained are limited for safety reasons since their strength is not sufficient to permit them to accommodate, if necessary, a product under pressure.

Also, a second purpose of the invention is to propose a machine satisfying the first purpose mentioned, permitting the butt-welding of the rolled blanks in order to render the ferrules obtained capable of accommodating products under pressure.

The problem to be solved for the purpose of satisfying the second purpose is how to hold the rolled blanks in a position permitting them to be welded, while on the one hand holding the edges together, and on the other hand keeping the end surfaces parallel.

It must be noted that, to satisfy both of these purposes, the common problem to be solved is to be found in the means for transferring the blanks from the rolling station to the welding station.

According to the invention, a machine for the automatic production of cylindrical ferrules from metal blanks, which are to be welded with their edges joined, i.e., "butt-welded," said machine preferably comprising a roller of the fluted roll type as described in the applicant's publication FR2637206, is characterized mainly in that it comprises the following, in an order beginning from the point of exit of the ferrules and going back to the point of entry of the blanks:

A welding station provided with means, called the first means, permitting the transfer of a rolled blank in a shape with its edges abutting and assuring that this shape will be maintained, and means, called the second means, for forming a continuous welded seam along said abutting edges, at least one station, called the transfer and continuous constriction station, provided with means, called the third means, for moving the rolled blanks on their longitudinal axis, and means, called the fourth means, simultaneously providing for the progressive constriction of the blank, so that, when it reaches the entry of the welding station, it will be in a shape in which its edges are abutting, at least one station, called the discontinuous .transfer station, having means, called the fifth means, for moving a blank along its axis, the rolling station constituted by a roller with rolls of the type referred to above and a station feeding the roller, and provided with means for picking blanks up from the stack, called the sixth means, or "pickers," and for transferring the blanks one by one from a stack to the entrance to the roller, and a servomechanism for the fine control of the bending means taking into account the thickness of each blank to assure the precise attainment of the diameter of the rolled blank with a precision on the order of a millimeter.

From the assemblage of these means the result is that metal blanks of ordinary thickness tolerance can be rolled and welded in a continuous manner without human intervention, the ferrules obtained being capable of accommodating a product under pressure.

In a preferred embodiment, in the first place, a supporting and guiding plate extends from the exit from the rolling station to the welding station through discontinuous and continuous transfer stations, the longitudinal edges of the blanks being separated by the guide plate along which they can run, the guide plate becoming thinner past the exit from the rolling station; in the second place, said fifth means are constituted by a mobile pusher running back and forth along the guide plate to move the blanks in a single direction from the roller to the continuous transfer station and, in the third place, said third means are constituted by two sets of wheels, those of the first set being situated on the outside of the blanks and being the driving wheels urged against those of the second set, the latter being situated inside of the blanks, said rollers of the first set being driven by motor means comprising a set of gears and so-called "cardan type" transmission means.

Advantageously, said first means are constituted by a cage supported by the frame of the machine, said cage being composed of two semicylindrical parts, a bottom one and an upper one, the bottom part being fastened to the upper part by resilient means; said second welding means can comprise particularly the T.I.G., M.A.G., M.I.G., plasma, submerged arc and laser processes, with support, and with or without a consumable electrode. The second means comprise a nozzle supported on the upper part of the cage and directed into the interior of the latter, said nozzle being provided with cooling means.

The result of this arrangement is that the resiliency of the cage permits bringing the abutting edges fully against one another at the exit from the continuous transfer station and holding the blanks in this shape during the welding operation.

According to a first variant, more particularly intended for making ferrules from blanks that are thick (between 1 and 5 mm, for example), in the first place, said fifth means are means for shifting a blank along each time that a previously shifted blank has been introduced into the continuous transfer station and for bringing the blank into axial abutment against the blank that preceded it in the station and, in the second place, said third means provide for the transfer of the blanks while still pushing the blank present in the welding station.

In a second variant, more particularly intended for making ferrules from blanks of lesser thickness (less than 1 mm), in the first place, said fifth means are means for shifting a blank each time that a previously displaced blank has been introduced into the welding station and has been sufficiently welded to keep its end edges in parallel planes; in the second place, said third means provide for the transfer of the blanks being welded one after the other and, in the third place, the machine has an additional transfer station situated between the rolling station and the fifth means.

It is to be noted that the additional transfer station is intended to reduce the travel of the pusher of the discontinuous transfer station so as to provide for a maximum rate of advancement of the ferrules into the welding station, the pusher being intended to lead a blank so as to bring it into contact with the preceding blank while the latter is still present in the continuous transfer station and is being welded.

Preferably, the blanks are held suspended by the guide plate through the discontinuous transfer station by means of a double set of wheels, between which the blanks are running, the wheels of each pair being disposed on either side of the guide plate, one of the sets being situated outside of the blanks and the other situated inside of the blanks; alternatively, the blanks could be supported by an elongated cylindrical mandrel connected to the machine frame by the guide plate.

According to an advantageous embodiment, the frame is composed of a plurality of interconnected separable units, each unit bearing a station.

The result of this arrangement is that the various stations of the machine can be separated, so as to facilitate repairs, for example, and to change the various transfer stations to obtain one or the other of said variants of the machine.

Figure 2:
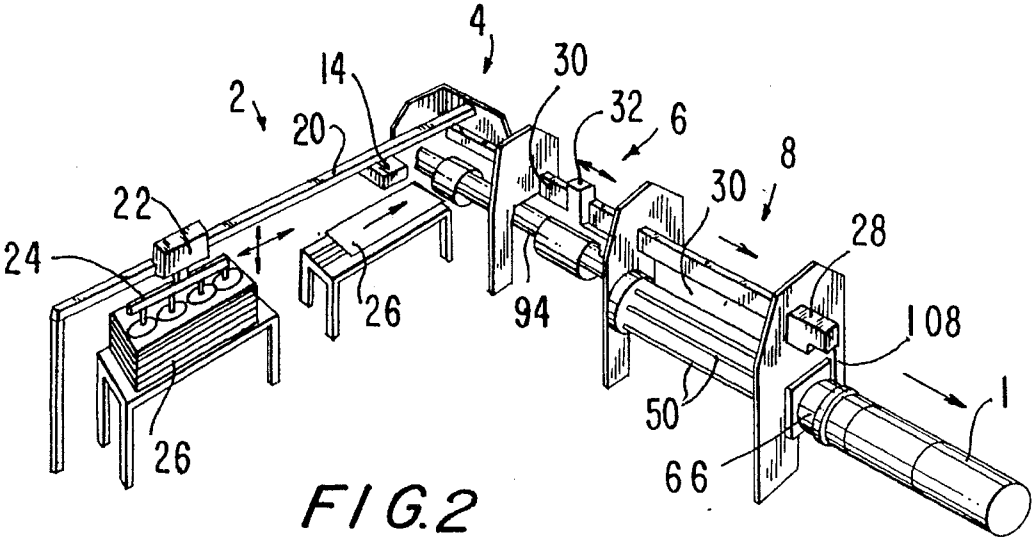
Figure 3:
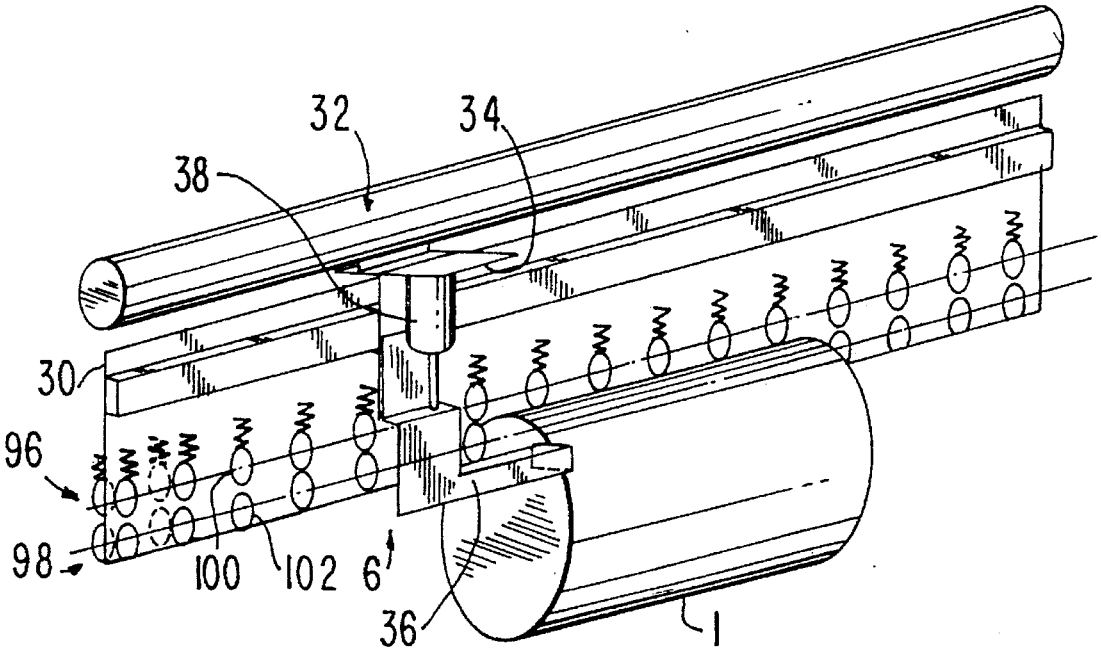
Figure 4:
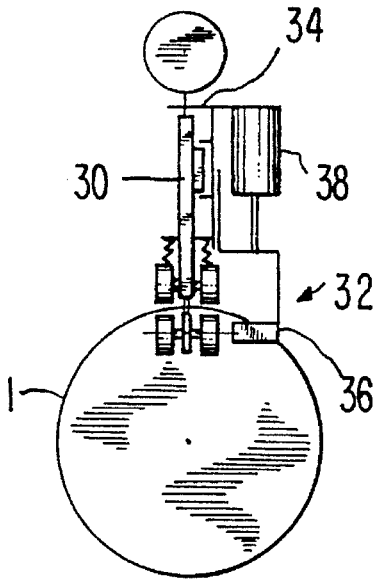
Figure 5:
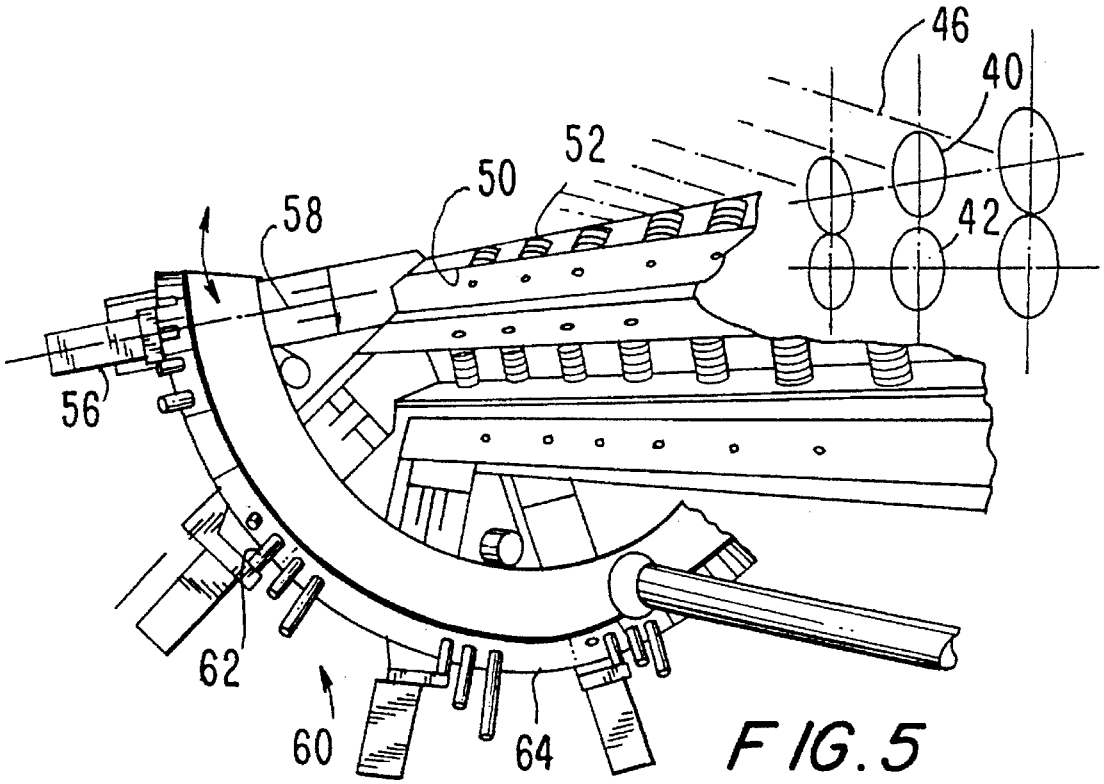
Figure 6:
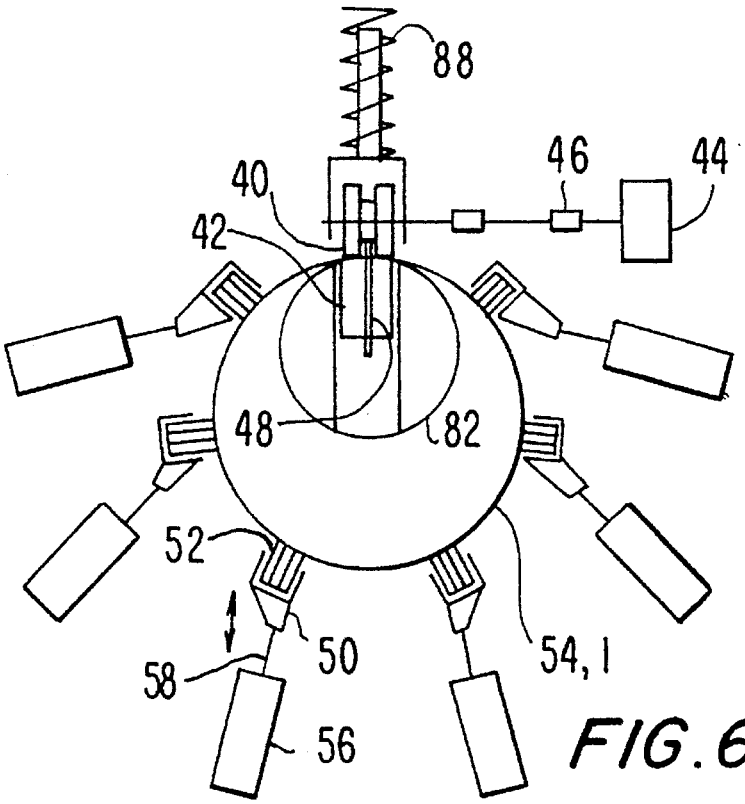
Figure 7:
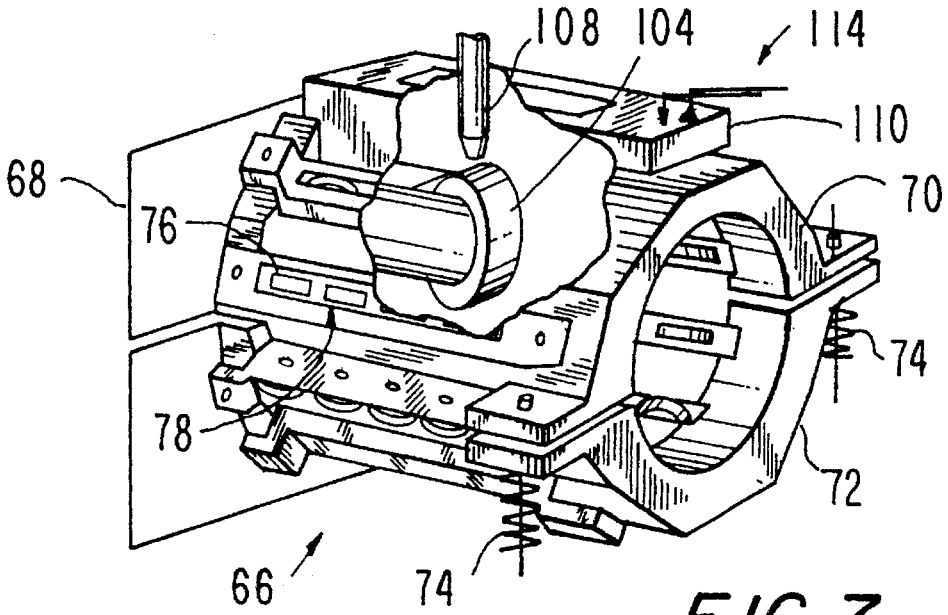

The present invention will be better understood and details relating thereto will appear in the description now to be given of preferred embodiments, in connection with the figures in the annexed drawings, wherein:

FIG. 1 is a overall view of the principal stations constituting a machine of the invention, including two variant embodiments, FIG. 2 is a simplified perspective view of a machine of the invention according to a first embodiment more particularly intended for the production of ferrules from thick metal blanks, FIGS. 3 and 4 are diagrammatic representations of a discontinuous transfer station of the invention, in perspective and in an end view, respectively, FIGS. 5 and 6 are diagrammatic representations of a continuous transfer station of said first variant, in perspective and in an end view, respectively, FIG. 7 is a partially cut-away view of a welding station of said first variant.

Figure 8:
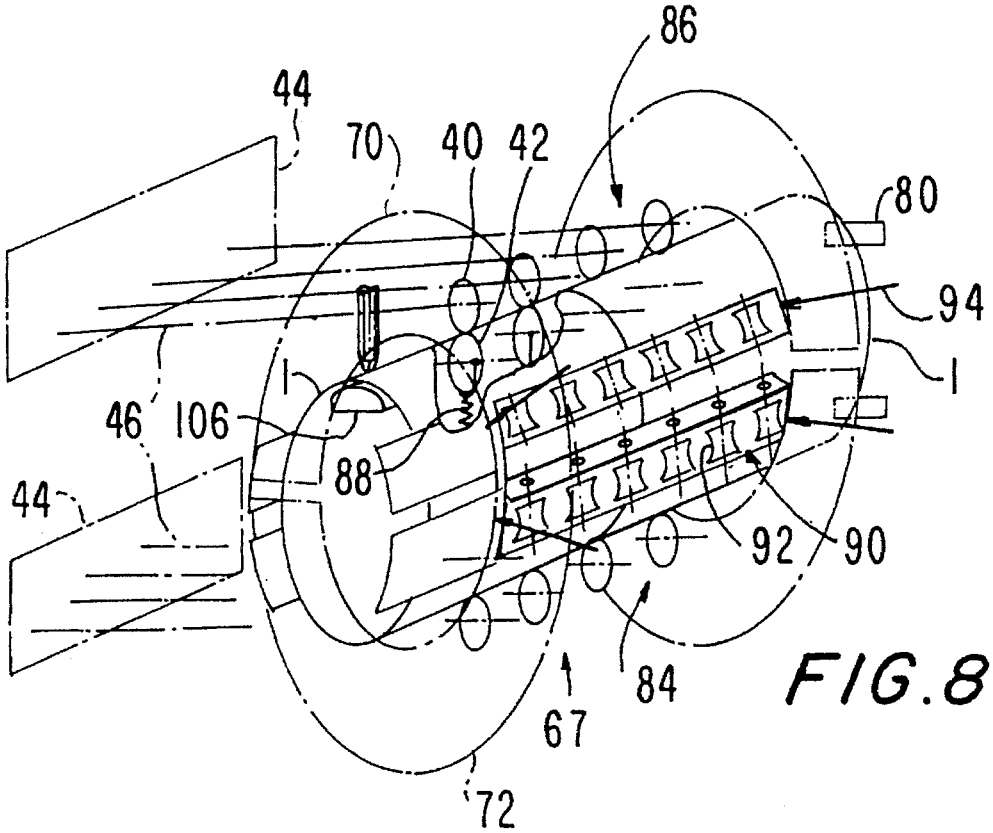

FIG. 8 is a diagrammatic, partially cut-away perspective view of a welding station and of a continuous transfer station according to a second variant of the invention, which is more particularly intended for the production of short ferrules from thin blank metal.

In FIG. 1, a ferrule production line according to the invention in general has mainly five stations, that is, in the direction of the movement of the material being processed: a feeder station 2, a roller 4 with fluted rolls (FR2637206), a discontinuous transfer station with pusher forming said fifth means, a continuous transfer station 8 provided with said third transfer means and means called fourth constriction means and, lastly, a welding station 10. In one variant, the discontinuous transfer station 6 comprises, on the one hand, said fifth means and, on the other, an additional transfer station 7 of the motorized wheel type, intended, if need be, to limit the travel of the pusher, as will be explained further on.

The servomechanism 12 of the roller 4 comprises a thickness detector 14 putting out a thickness signal, a computer means 16 receiving said thickness signal and putting out binary signals, a stepper motor 18 receiving said binary signals to govern the separation of the rolls and thus the rolling radius.

In FIG. 2 it will be noted that the feeder station 2 is constituted mainly by a transfer track 20 for a carriage 22 with suction cups 24 acting to pick up the stacked flat blanks, and that the welding means 28 are of the arc welding type, with support 104 (FIG. 7) or 106 (FIG. 8) and electrode 108.

Returning to FIG. 1, the thickness detector 14 is situated on the transfer path 20 of the blanks 26. Said thickness detector 14 is a mechanical gauge of the "Palmer" type, measuring the thickness of the blank 26 at one point. In the variant shown, the detector 14 is disposed substantially vertically above the transfer path 20, and that the edge of the blank 26, on which the measurement is made, is the transverse edge, which will be the first to pass between the rolls of the roller 4.

A supporting and guiding plate 30 extends from the exit from the rolling station 4 to the welding station 10 along the discontinuous and continuous transfer stations 6 and 8. The butt joints of the blanks are held apart and guided by the guide plate 30, along which they can run, said guide plate 30 thinning from, for example, 12 mm down to 1.4 mm from the exit of the rolling station 4 for blanks of a thickness between 1 and 5 mm and from 12 to 0.2 mm for blanks less than 1 mm thick.

In FIGS. 2, 3 and 4, the discontinuous transfer station 6 comprises a pusher 32, which can be reciprocated back and forth along the guide plate 30 to move the blanks in only one direction from the roller 4 toward the continuous transfer station 8. The pusher 32 comprises a carriage 34 running along the guide plate 30 and driven by pneumatic means, such as a horizontal jack not shown. The carriage 34 supports a pusher finger 36 which can be retracted by a jack 38; the finger 36 is either retracted during the "return" movement or it is in the active position during the "forward" movement. The running of the carriage 34 is controlled from a control cabinet not shown.

The continuous transfer station of FIGS. 2, 3 and 4 is also applicable to the second variant, with four fingers (fingers 80, FIG. 8) thrusting against both sides of the blank at its upper and lower areas, for the purpose of holding ferrules of thin metal so that their end surfaces are in parallel planes; the four fingers are retractable laterally to permit the carriage 34 to return toward the exit of said additional transfer station 7.

Continuous transfer and welding stations of a first variant of the machine are represented in FIGS. 5 to 7. In this variant, the pusher 32 displaces a blank each time that a blank previously displaced has been introduced into the continuous transfer station 8: the blank is thrust axially against the blank that preceded it in the station 6, and the continuous transfer means provide for the transfer of the blanks while pushing the present blank into the welding station 10.

Similar stations of a second variant of the machine are shown in FIG. 8. In this variant the pusher 32 holds the blank that is being welded until it has been sufficiently welded, on a length of about one centimeter, for example, so as to keep its end surfaces in parallel planes; then the pusher 32 goes to find the next blank at the exit of the additional transfer station 7 so as to bring it into contact with the blank being welded, while the continuous transfer means provide for the transfer of the successive blanks that are being welded. Advantageously, the additional transfer station 7, shown schematically in FIG. 1, is inserted between the exit from the roller 4 and the discontinuous transfer station 6, in order to shorten the stroke of the movable pusher 32 and, lastly, to increase the working rate of the machine.

In FIGS. 5, 6 and 8, the third, continuous transfer means are constituted by a double set 40 and 42 of wheels, the wheels of the first set 40 being situated on the outside of the blanks and being drive wheels urged against the wheels of the second set 42, the latter being situated on the inside of the blanks. The drive wheels 40 are powered by drive means comprising gears 44 and transmission means 46 known as "cardan shafts." Preferably, the diameter of the drive wheels 40 situated at the entrance to the continuous transfer station 8 is slightly greater than the diameter of the drive wheels 40 following them, any possible spacing between two successive blanks being thus corrected due to this difference in diameter. It will be noted in FIG. 6 that the inside wheels 42 have a flange 48 emerging from between the edges of the blanks in the prolongation of the guide plate 30 for the purpose of guiding those edges.

In FIGS. 2, 5 and 6, the fourth means, the progressive constriction means, are constituted by a plurality of longitudinal bars, such as 50, provided with wheels, such as 52, tangent to an envelope 54 (FIG. 1) or surface that is very slightly tapering. Said bars 50 are supported at least at one of their extremities by cam-action means for bringing them nearer to or farther away from the axis of said envelope 54. The cam-action means are used to provide for variations in the nominal diameter of the ferrules.

According to a first embodiment, the variations are discontinuous, which corresponds to ball bearing cams, with manual adjusting means: the cam-action means comprise jacks, such as 56, the shafts 58 of which are connected respectively to the bars 50, the stroke of the jacks 56 being limited by means of a set 60 of invertible abutments 62: the abutments 62 are supported by a ring 64, which can pivot around the axis of said envelope 54, to be placed facing their respective jack 56 according to the desired nominal diameter.

In another embodiment not shown in the Figures, the variations could be continuous, which would correspond to a cam, such as a ramp that is continuously progressive, with motor-driven means of variation.

In FIG. 7, the first means, for keeping butt joints edge to edge while being welded, are constituted by a cage 66 supported by the frame 68 of the machine, said cage 66 being composed of two semicylindrical parts 70 and 72, the one 72 being the lower one and the other 70 the upper.

The lower part 72 is connected to the upper part 70 by resilient means 74 making it possible, in spite of any diameter differences in the blanks, to bring the lateral edges of the blanks into contact at the exit from the continuous transfer station 8.

Note the presence of a plurality of sets, such as 78, of wheels, such as 76, supported by each of the lower 72 and upper 70 parts of the cage, each set 78 of wheels extending along a generatrix of the cage 66.

In FIG. 8, a cage 67 is similar to cage 66 shown in FIG. 7, said cage 66 extending in the direction from the discontinuous transfer station 6, said prolongation containing the third (40, 42) and fourth means.

So, whereas in FIGS. 5 and 6 the set of drive wheels 40 is supported by the guide plate 30 and the set of inside wheels 42 is supported by a mandrel 82 itself supported by the guide plate 30, it will be noted in FIG. 8 that the set of drive wheels 40 is supported by the cage 67 and is divided into two groups 84 and 86, the one 84 supported by cage 67 in its lower area, the other 86 in its upper area.

One of the sets of wheels 40 and/or 42 is provided with elastic means 88 designed to apply pressure against the other set of wheels. In FIG. 8, it is the inside wheels 42 that have said elastic means 88 whereas, in FIGS. 5 and 6, it is the drive wheels 40.

In FIG. 8, the fourth means are constituted, on the one hand, by a plurality of groups, such as 90, of wheels, such as 92, of the hyperboloidal type, also called "diabolo" wheels, said wheels 92 conforming to the outside surface of the blanks 1. The sets of "diabolo" wheels 92 are respectively supported by the cage 67 through the medium of means 194 for controlling their tangency to said adjacent conical surface 54. It will be noted that the resilient connection 74 in FIG. 7 between the two upper 70 and lower 72 parts of the cage 67 is part of the fourth means.

It will be noted that FIG. 2, on the one hand and, FIGS. 3 and 4, on the other, show different means for supporting the blanks 1 along the discontinuous transfer station 6:

In FIG. 2, the continuous transfer station 8 and the discontinuous transfer station 6 have each an elongated cylindrical mandrel 94 connected to the frame by the guide plate 30, said mandrel being designed to support the rolled blanks 1, the longitudinal edges of which are separated by said guide plate 30 along which they can run. The mandrels 94 are situated in the prolongation of the supporting roll of the roller 4 and of its bearing;

In FIGS. 3 and 4, the blanks 1 are suspended from the guide plate 30 along the discontinuous transfer station 6 by means of two sets 96 and 98 of pairs of wheels, such as 100 and 102, between which the blanks 1 are running: the pairs of wheels 100 and 102 are disposed one on either side of the guide plate 30, some of them, 100, being situated on the outside of the blanks 1, the others, 102, on the inside of the blanks.

It will be furthermore noted that the shared support of the two means can be either a knurled wheel 104 as shown in FIG. 7 or an anvil as shown in FIG. 8. A nozzle 110 is supported in the upper part 70 of the cages 66 and 67, said nozzle being equipped with cooling means 114.

Advantageously, the nozzle 110 is made of bronze and the blanks 1 are pressed against the inside face of the nozzle 110 by resilient means 74 connecting together the lower part 72 and upper part 70 of cages 66 and 67.

At the exit of the machine, the ferrules can be separated from one another either manually by an operator or mechanically by motor-driven means contained in a connected machine.

I claim:

1. Machine for the automatic production of cylindrical ferrules by rolling and welding flat metal pieces, said machine comprising a welding station provided with means enabling the transfer of a rolled blank and with continuous welding means, at least one transfer station provided with means enabling the transfer, along their longitudinal axis, of rolled blanks and with means simultaneously enabling the progressive constriction of the blank to bring it, when it arrives at the entry of the welding station, into the shape for welding, a rolling station constituted by a rolling machine with rolls and comprising means for discharging a blank along its axis, and a rolling machine feeder station, provided with means for picking up flats from a stack one by one and transferring them to the entry of the rolling machine, characterized:

in that one said transfer station comprises fifth means for displacing a blank each time that a previously displaced blank has been introduced into the transfer station, and for keeping its end surfaces in parallel planes, and bringing one end of a blank into axial contact against the end of the blank that has preceded it in the station, in that one said transfer station for the rolled blanks comprises third means for bringing the blanks to the entry of the welding station, and fourth means for putting the blanks into a butt-joined shape, in that first means are constituted by a cage supported by the frame of the machine, said cage being composed of two substantially semicylindrical parts, one the lower part and the other the upper part, the lower part being joined to the upper part by resilient means, by means of which it is possible to perform the welding between said butt-joined edges by forming a welded seam since, on the one hand, these edges are butted together and, on the other, there is no space separating the ends of two consecutive ferrules in the welding station.

2. Machine according to claim 1, characterized in that said continuous welding machines comprises means called second means comprising a nozzle supported on the upper part of the cage and pointing into the internal zone of the latter, said nozzle, being provided with cooling means.

3. Machine according to claim 1, characterized in that said station for feeding flat metal pieces comprises:

a transfer path for a carriage with suction cups serving as an unstacker of stacked flat metal pieces, a thickness detector measuring the thickness of a metal piece at one point, the thickness detector being disposed substantially directly above the transfer path, the edge of the metal piece, on which the measurement is performed, being the transverse edge, which Will first penetrate between the rolls of the rolling machine, and in that, the rolling machine being of the fluted roll type, a servomechanism for the fine control of the rolling means takes into account the thickness of each piece to enable, with precision, the obtaining of a rolled blank with a precision on the order of a millimeter.

4. Machine according to claim 3, characterized in that a guide plate extends from the exit of the rolling station up to the welding station along the continuous and discontinuous transfer stations, the longitudinal edges of the blanks being held apart by the guide plate becoming thinner past the exit of the rolling station, in that said fifth means are constituted by a pusher reciprocating along the guide plate to move the blanks in one direction from the rolling machine toward the continuous transfer station, said pusher being constituted by a carriage running along the guide plate by virtue of pneumatic means and supporting at least one retractable pusher finger, said finger being either retracted during the return movement or placed in the working position during the outward movement corresponding to the movement transferring blanks from the rolling station up to the continuous transfer station, and in that said third means are constituted by a double set of wheels, those of the first set being situated outside of the blanks and being driving wheels urged against those of the second set, the latter being situated outside of the blanks, said wheels of the first set being driven by driving means comprising a gear box and transmission means defined as cardan shafts, any one of said sets being equipped with resilient means for applying said pressure on the blanks against the other set of wheels, the wheels of the second set having a flange emerging from between the edges of the blanks in the prolongation of the guide plate for the purpose of guiding them.

5. Machine according to claim 4, characterized:

in that the first set of wheels of the third means is supported by the guide plate, the second set of wheels of the third means being supported by a mandrel itself supported by the guide plate, in that the fourth means are constituted by a plurality of longitudinal bars provided with wheels tangent to a nearby tapering surface of the cylinder, said bars being supported at least at one of their extremities by camaction means to draw them away or bring them toward said tapering surface, and in each of the parts, lower and upper, of said cage constituting the first means is provided with a plurality of groups of equally distributed wheels, each group of wheels extending along a generatrix of the cage.

6. Machine according to claim 5, characterized:

in that the first set of wheels of the third means is supported by the guide plate, the second set of wheels of the third means being supported by a mandrel, itself supported by the guide plate, in that the fourth means are constituted by a plurality of longitudinal bars provided with wheels tangent to a nearby tapering surface of the cylinder, said bars being supported at at least one of their extremities by camaction means to move them away from or toward said tapering surface, and in that each of the parts, lower and upper, of said cage constituting the first means is provided with a plurality of groups of equally distributed wheels, each group of wheels extending along a generatrix of the case.

7. Machine according to claim 6, characterized:

in that the carriage of the discontinuous transfer station is provided with at least four fingers distributed on both sides of the guide plate and designed to be in contact with the blank it its lower and upper zones, the retraction of the fingers being performed laterally, in that the cage is prolonged in the direction of the discontinuous transfer station, said prolongation containing said fourth and third means, in that the two sets of wheels of the third means is supported by the cage and is divided into two groups, one supported in the lower area of the cage, the other in the high area, and in that the fourth means are constituted, on the one hand, by a plurality of sets of hyperboloidal wheels, said wheels conforming to the outer surface of the blanks, the groups of wheels being respectively supported by the cage via means of controlling their tangency to said nearby tapering surface of the cylinder and, on the other, by the resilient coupling between the two set upper and lower parts of the cage.

8. Machine according to claim 7, characterized:

in that the blanks are supported along the discontinuous transfer station by an elongated cylindrical mandrel connected to the frame of the machine by the guiding plate.

9. Machine according to claim 8, characterized:

in that the blanks are held suspended by the guide bar along the discontinuous transfer station by means of a double set of pairs of wheels, between which the blanks run, the wheels of each pair being disposed one on each side of the guide plate, one of the sets being situated outside of the blanks and the other being situated inside of the blanks.

10. Machine according to claim 9, characterized in that the various stations are separable from one another.

* * * * *